US009478091B2

(12) United States Patent
Gregerson

(10) Patent No.: US 9,478,091 B2
(45) Date of Patent: Oct. 25, 2016

(54) DIGITAL MEDIA RENTAL AND RETURN KIOSK HAVING A THREE-POSITION LOCKABLE GATE MECHANISM AND METHODS OF OPERATING A DIGITAL MEDIA RENTAL AND RETURN KIOSK

(75) Inventor: David Gregerson, Lawrenceville, GA (US)

(73) Assignee: NCR CORPORATION, Duluth, GA (US)

( * ) Notice: Subject to any disclaimer, the term of this patent is extended or adjusted under 35 U.S.C. 154(b) by 0 days.

(21) Appl. No.: 13/194,448

(22) Filed: Jul. 29, 2011

(65) Prior Publication Data

US 2013/0184856 A1 Jul. 18, 2013

(51) Int. Cl.

| | |
|---|---|
| ***G07F 11/00*** | (2006.01) |
| ***G07F 7/06*** | (2006.01) |
| ***G07F 11/16*** | (2006.01) |
| *G07F 17/00* | (2006.01) |

(52) U.S. Cl.

CPC ..... *G07F 11/005* (2013.01); *G07F 7/069* (2013.01); *G07F 11/165* (2013.01); *G07F 17/005* (2013.01)

(58) Field of Classification Search

CPC ..... G07F 11/005; G07F 7/069; G07F 17/005
USPC ..... 700/232, 240, 243; 221/241
See application file for complete search history.

(56) References Cited

U.S. PATENT DOCUMENTS 4,915,205 A * 4/1990 Reid ..... G07F 7/069 194/205
5,418,763 A * 5/1995 Ichikawa et al. ..... 369/84
5,508,859 A * 4/1996 Hu ..... G11B 17/225 360/92.1
5,991,256 A * 11/1999 Nonaka ..... G11B 17/225 369/30.52
6,182,857 B1 * 2/2001 Hamm et al. ..... 221/2
7,444,296 B1 * 10/2008 Barber ..... G06Q 10/087 194/205
7,774,233 B2 * 8/2010 Barber ..... G06Q 30/06 194/205
7,774,268 B2 * 8/2010 Bradley ..... 705/38
8,095,236 B2 * 1/2012 Rudy et al. ..... 700/238
8,204,622 B2 * 6/2012 Yepez ..... G07F 7/069 221/282
8,626,614 B2 * 1/2014 Barber ..... G06Q 30/06 700/213
8,930,240 B2 * 1/2015 Barber ..... 705/16
2002/0046122 A1 * 4/2002 Barber ..... G06Q 10/087 705/17
2007/0050266 A1 * 3/2007 Barber et al. ..... 705/26
2007/0051802 A1 * 3/2007 Barber ..... G06Q 30/06 235/383
2009/0039103 A1 * 2/2009 Sobonski ..... B41J 3/4071 221/292
2009/0326708 A1 * 12/2009 Rudy et al. ..... 700/234
2013/0184856 A1 * 7/2013 Gregerson ..... 700/232

* cited by examiner

*Primary Examiner* — Michael K Collins
(74) *Attorney, Agent, or Firm* — Michael Chan

(57) ABSTRACT

A digital media rental and return kiosk includes a store arranged to store physical digital media items. The kiosk further includes a user interface (i) having a dispense and return slot, and (ii) arranged to enable a customer to interact with the kiosk to either rent a digital media item or return a digital media item through the slot. The kiosk also includes a delivery system arranged to (i) transport a digital media item to be rented from the store to the slot, and (ii) transport a digital media item to be returned from the slot to the store. The kiosk further includes a gate mechanism including a gate which is (i) movable from a closed position to a first opened position to allow a digital media item to be rented to be dispensed through the slot to a customer, and (ii) movable from the closed position to a second opened position which is different from the first opened position to allow a digital media item to be returned to be inserted through the slot by the customer.

10 Claims, 10 Drawing Sheets

DIGITAL MEDIA RENTAL AND RETURN KIOSK HAVING A THREE-POSITION LOCKABLE GATE MECHANISM AND METHODS OF OPERATING A DIGITAL MEDIA RENTAL AND RETURN KIOSK

BACKGROUND

The present application relates to digital media rental and return kiosks, and is particularly directed to a digital media rental and return kiosk having a three-position lockable gate mechanism and methods of operating a digital media rental and return kiosk, such as a digital video disc ("DVD") rental and return kiosk.

A typical DVD rental and return kiosk includes a gate which is movable between a closed position and an opened position as a customer interacts with the DVD kiosk to either rent a DVD or return a DVD. The gate blocks a slot through which either a DVD to be rented can be dispensed to the customer or a DVD to be returned by the customer can inserted. When the customer rents a DVD, the gate moves from the closed position to the opened position to unblock the slot through which the DVD to be rented can be dispensed to customer. The gate then moves back to the closed position. Similarly, when the customer returns a DVD, the gate moves from the closed position to the opened position to unblock the slot through which the DVD to be returned can be inserted by the customer. The gate then moves back to the closed position.

A drawback in known DVD rental and return kiosks is that some customers with multiple DVDs to be returned will try to insert more than one DVD at a time into the slot in hopes of more quickly returning the DVDs. Certain of these customers may even try to force multiple DVDs into the slot and thereby causing a jam in the slot. When the slot becomes jammed, a service call by field service personnel is usually required to clear the jam condition. It would be desirable to provide a DVD kiosk in which service calls to clear such jam conditions are reduced.

SUMMARY

In accordance with one embodiment, a digital media rental and return kiosk includes a store arranged to store physical digital media items. The kiosk further includes a user interface (i) having a dispense and return slot, and (ii) arranged to enable a customer to interact with the kiosk to either rent a digital media item or return a digital media item through the slot. The kiosk also includes a delivery system arranged to (i) transport a digital media item to be rented from the store to the slot, and (ii) transport a digital media item to be returned from the slot to the store. The kiosk further includes a gate mechanism including a gate which is (i) movable from a closed position to a first opened position to allow a digital media item to be rented to be dispensed through the slot to a customer, and (ii) movable from the closed position to a second opened position which is different from the first opened position to allow a digital media item to be returned to be inserted through the slot by the customer.

DETAILED DESCRIPTION

Figure 1:
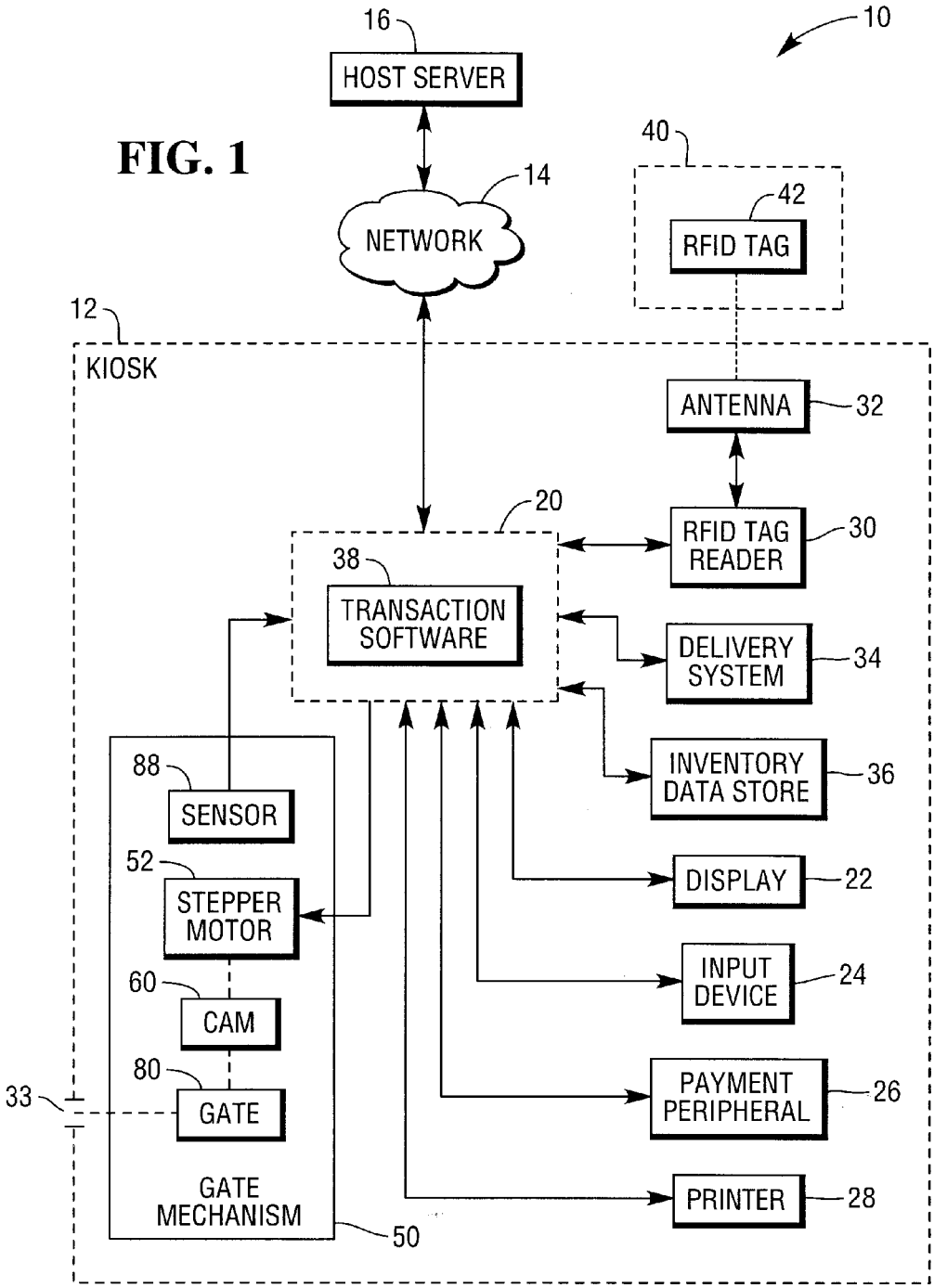
FIG. 1 is a block diagram of an example digital media transaction system.

Referring to FIG. 1, example digital media transaction system 10 primarily includes example digital media rental and return kiosk 12. Kiosk 12 dispenses digital media in storage devices 40, which may include compact discs (CDs) and digital video discs (DVDs). CDs and DVDs are leading portable digital media storage devices. Hundreds of millions of discs are produced each year. These discs are used to store digital media files including, but not limited to movies, television shows, music, music videos, video game software, productivity software and a wide array of additional file types and file formats. These discs are available in pre-recorded, recordable and rewritable formats.

Kiosk 12 may also dispense digital media in other storage devices 40, such as Secure Digital (SD) cards, or may also electronically download digital media to customer-provided storage devices. A digital media transaction may include a sale of digital media or licenses to digital media. Digital media may include, but not be limited to, movies, television shows, music, music videos, video game software, productivity software and a wide array of additional file types and file formats.

Kiosk 12 may include computer 20, display 22, input device 24, payment peripheral 26, printer 28, radio frequency identification (RFID) tag reader 30, delivery system 34, and inventory data store 36.

Computer 20 includes a processor, memory, program and data storage. Computer 20 may execute an operating system such as a Microsoft operating system, and a web browser for viewing web pages. Computer 20 controls operation of kiosk 12. Computer 20 executes transaction software 38, which displays images of screens and records operator selections from those screens during a digital media transaction.

Display 22 displays the images of the transaction screens. Input device 24 records operator selections during a digital media transaction. Input device 24 may include a touch sensitive device or a keyboard. Input device 24 and display 22 may be combined as a touch screen.

Payment peripheral 26 may include one or more of a card reader for reading credit, debit, and/or loyalty cards; a currency acceptor; a currency dispenser; a coin acceptor; and a coin dispenser. Printer 28 includes a receipt printer, but may print additional information, such as coupons or other offers or promotions.

RFID tag reader 30 couples to antenna 32, which in this example, is located in the vicinity of digital media dispense and return slot 33 (see FIG. 2) of kiosk 12. RFID tag reader 30 identifies dispensed or returned digital media or both. Dispensed or returned storage devices 40, such as CDs and DVDs, are equipped with RFID tags 42. Alternatively, or in addition, containers of storage devices 40, such as sleeves, jewel cases, or other types of cases may include RFID tags.

Delivery system 34 delivers digital media to customers following selection and payment. For example, delivery system 34 may deliver digital media discs from storage locations within kiosk 12 or may burn digital media onto blank discs and deliver a newly burned disc. As another example, delivery system 34 may electronically download digital media to suitable electronic storage devices, such as customer provided mobile devices. Delivery system 34 also captures and stores returned digital media to the storage locations within kiosk 12.

Inventory data store 36 contains an inventory of digital media within kiosk 12, either physical discs or digital media files or both. Transaction software 38 updates the inventory of digital media each time a digital media item is dispensed or received. Transaction software 38 may also send updated inventory information to host server 16 via network 14. Host server 16 may manage inventory in a plurality of kiosks 12. Network 14 may include a cellular communication network, a global communications network also known as the Internet, a wired or wireless network, or any combination of such networks.

Lockable gate mechanism 50 includes stepper motor 52 operatively coupled to cam assembly 60 which, in turn, is operatively coupled to movable gate member 80. Gate 80 covers and uncovers dispense and return slot 33. Gate mechanism 50 further includes sensor 88 which provides a sensor output signal indicative of position of gate 80. Sensor 88 may comprise an optical type of sensor, for example.

Computer 20 monitors sensor output signal of sensor 88 and provides a control signal to control operation of stepper motor 52. Stepper motor 52 is controlled to move cam assembly 60 to open and close gate 80 and thereby to unblock and block dispense and return slot 33, as will be described hereinbelow.

Figure 2:
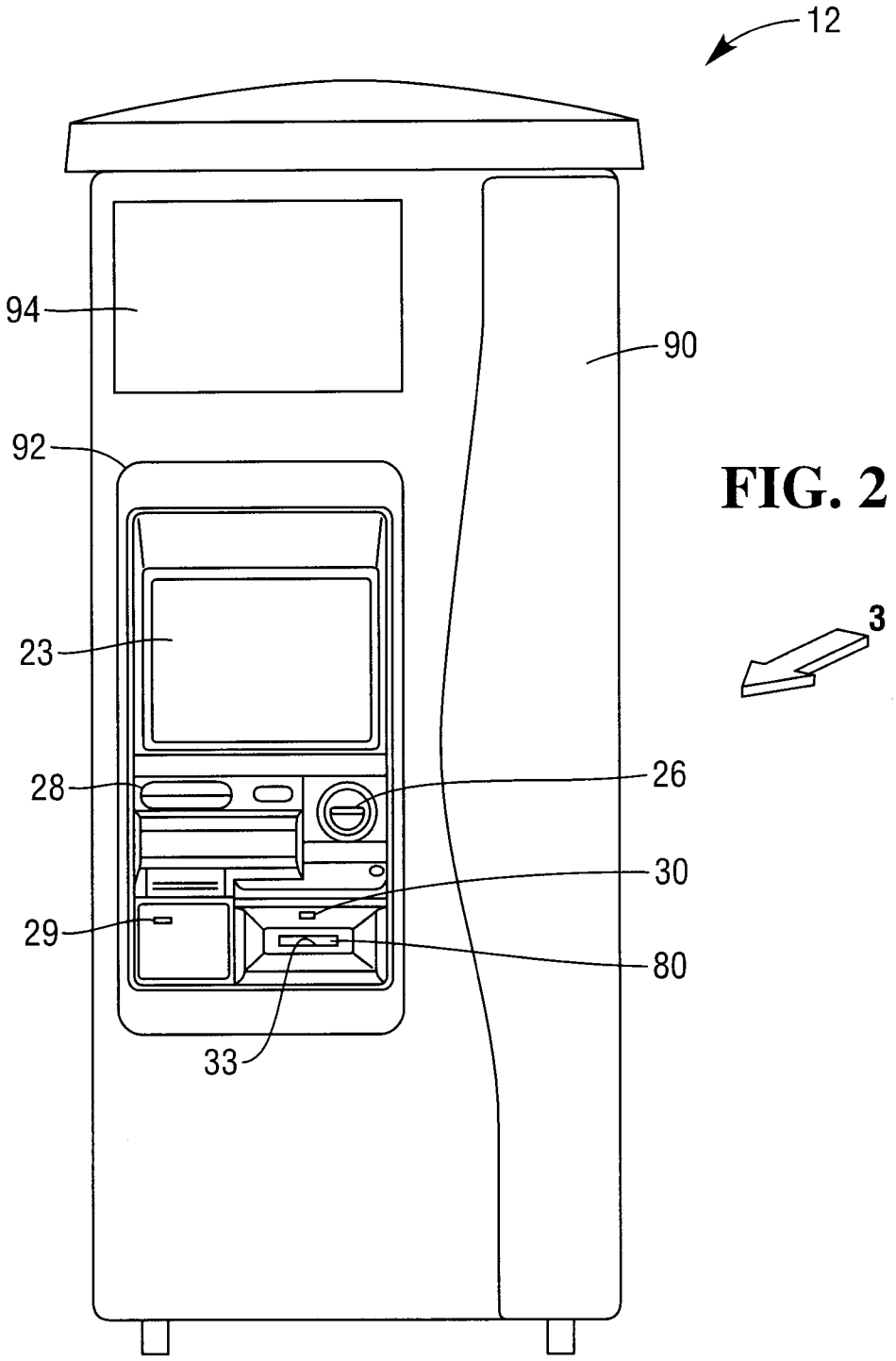
FIG. 2 is a front elevational view of a digital media rental and return kiosk shown in the system of FIG. 1 and embodying a three-position lockable gate mechanism in accordance with one embodiment.

Referring to FIG. 2, example kiosk 12 is illustrated. Kiosk 12 may be based upon the entertainment kiosk disclosed in commonly-assigned published U.S. application Ser. No. 10/866,387, publication number 2004/0254676, entitled "AUTOMATED BUSINESS SYSTEM AND METHOD OF VENDING AND RETURNING A CONSUMER PRODUCT". This published application is hereby incorporated by reference.

Kiosk 12 includes housing 90 having storage locations for storing digital media. Kiosk 12 further includes user interface 92 which includes touch screen 23 (which is a combination of display 22 and input device 24 shown in FIG. 1), card reader 26, printer 28, printer receipt slot 29, and dispense and return slot 33. Kiosk 12 may further include auxiliary display 94 for displaying movie trailers, promotions, and other information under the control of transaction software 38.

Dispense and return slot 33 provides an opening through which digital media items (DVDs in this example) in their cases are dispensed and into which returned DVDs in their cases may be inserted. As shown in FIG. 2, gate 80 blocks dispense and return slot 33 full-ways. RFID tag reader 30 may be located in vicinity of dispense and return slot 33 (as shown in FIG. 2) or in vicinity of delivery system 34. Antenna portion 72 is driven by RFID tag reader 30 to produce an electromagnetic field at an RFID frequency, such as 13.56 MHz.

Figure 3:
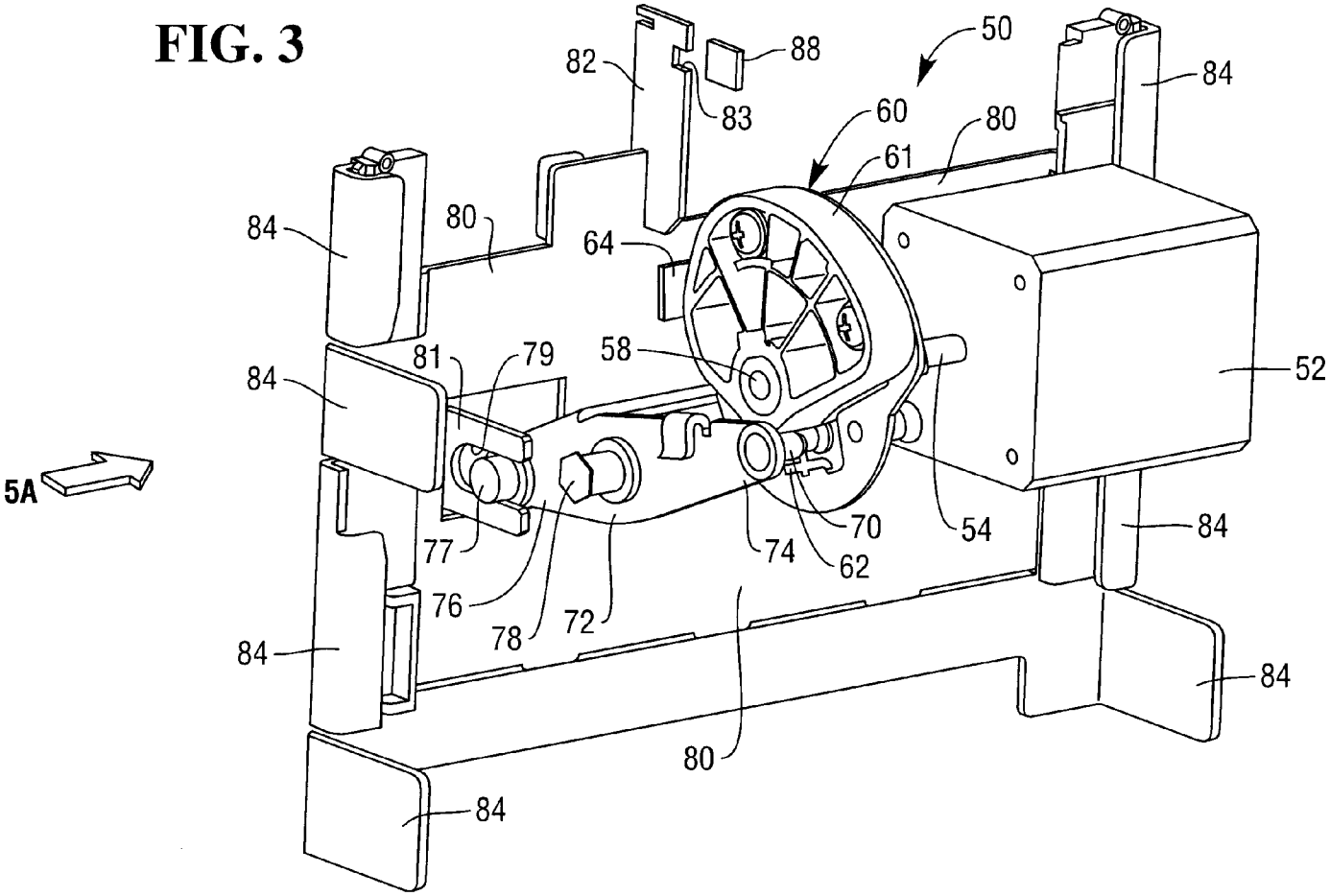
FIG. 3 is a rear perspective view looking out of the page and approximately in the direction of arrow "3" shown in FIG. 2, and showing parts of the three-position lockable gate mechanism.
Figure 4:
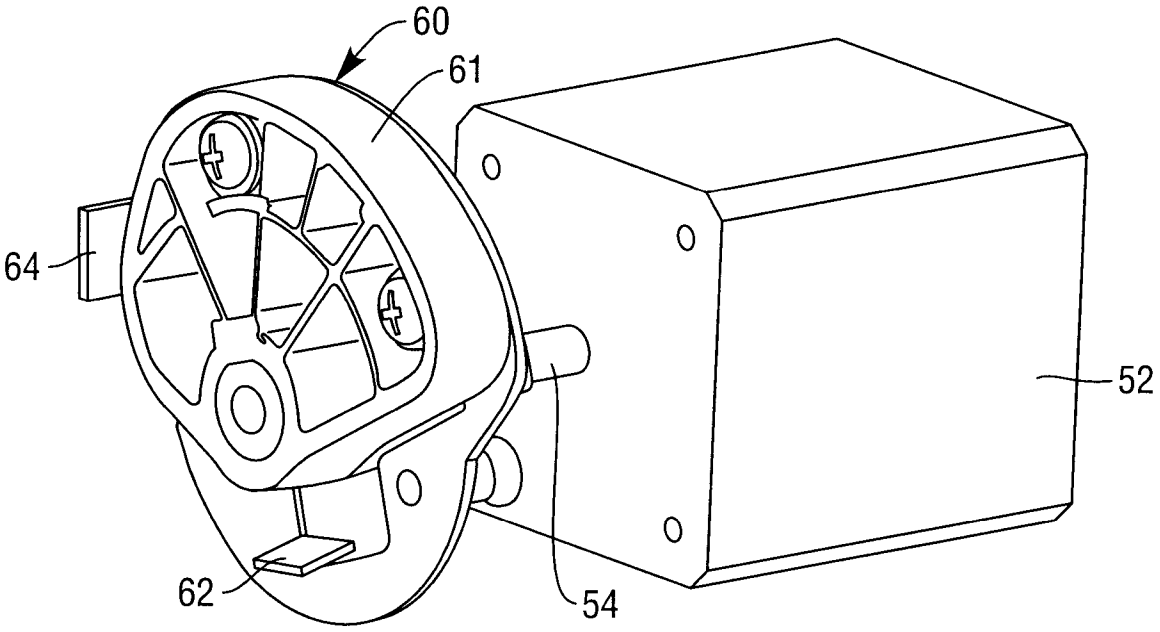
FIG. 4 is an enlarged view of a portion of FIG. 3, and showing details of a stepper motor and a cam of the gate mechanism.

Referring to FIG. 3, gate 80 is supported by frame member 84 for movement in the up and down directions as viewed looking at FIG. 3. Gate 80 includes horizontally-extending U-shaped portion 81 having a U-shaped opening 79 and vertically-extending portion 82 having a notched-out portion 83. Notched-out portion 83 enables sensor 88 to provide sensor output signal indicative of whether gate 80 is in fully-closed position as shown in FIG. 3.

Stepper motor 52 is mechanically coupled through shaft 54 to cam assembly 60. Cam assembly 60 has cam surface 61 and is rotatable about pivot point 58. Pivot point 58 lies along the longitudinal central axis of rotation of the shaft 54 of stepper motor 52.

Cam follower pin 70 rides along cam surface 61 when cam assembly 60 rotates about pivot point 58. Cam follower pin 70 is attached to one end portion 74 of linkage member 72 which is pivotable about pivot support 78. Accordingly, cam follower pin 70 is pivotable about pivot support 78. Opposite end portion 76 of linkage member 72 has stud pin 77 which is operatively and slidably coupled in U-shaped opening 79 of horizontally-extending U-shaped portion 81 of gate 80 to move gate 80 either up or down (as viewed looking at FIG. 3) as linkage member 72 pivots about pivot support 78.

Figure 5A:
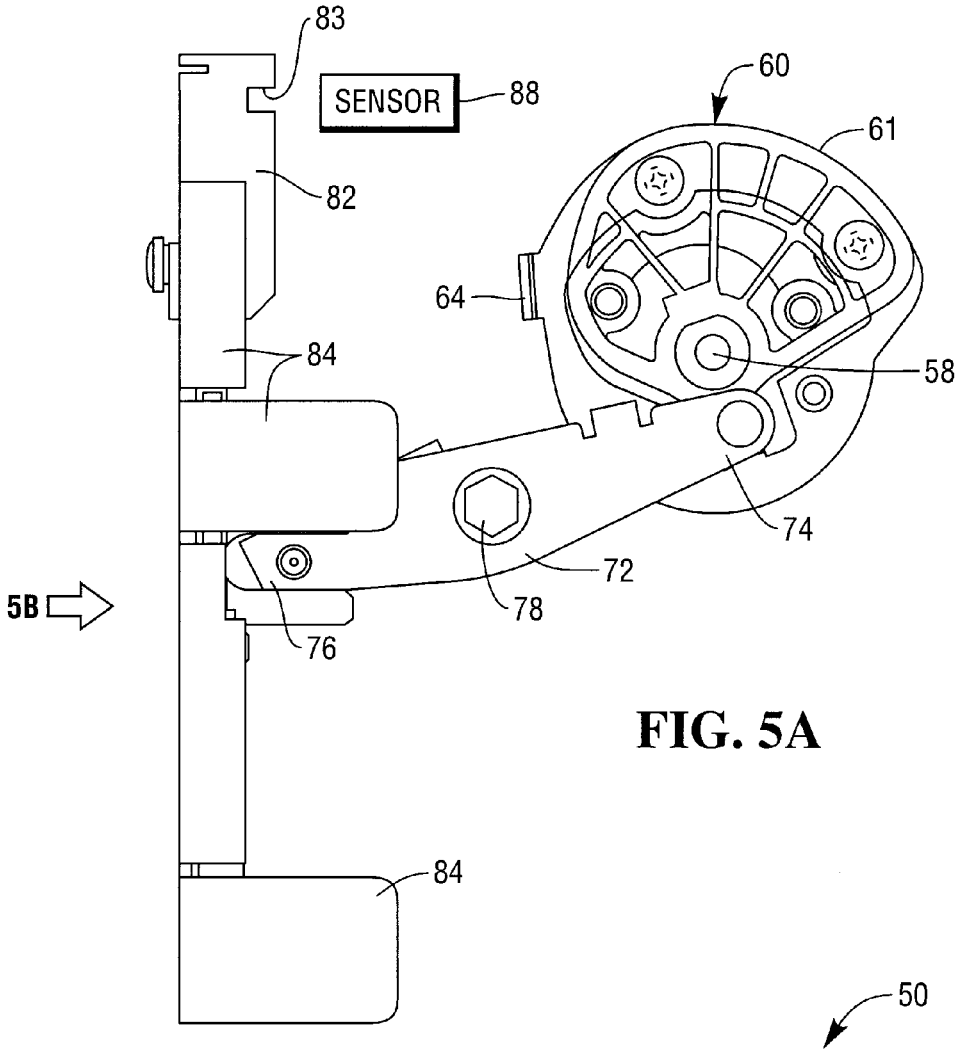
FIG. 5A is an elevational view looking approximately in direction of arrow "5A" shown in FIG. 3, and showing parts of the gate mechanism in a locked condition.
Figure 5B:
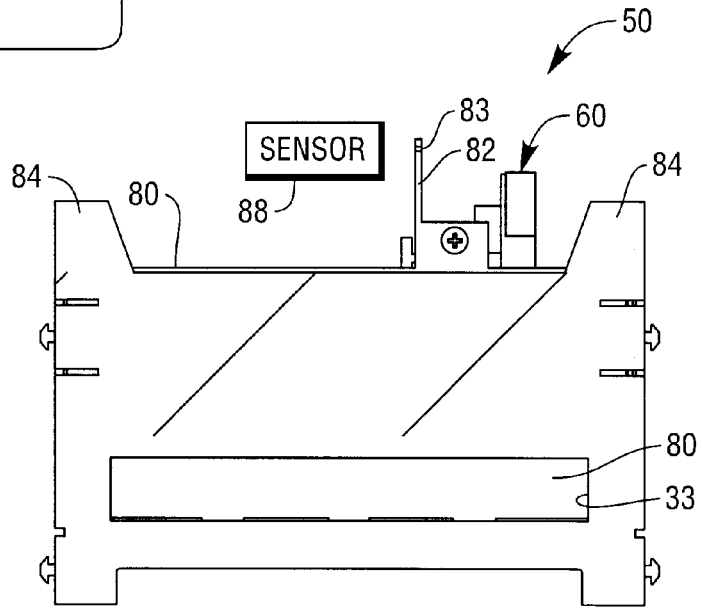
FIG. 5B is an elevational view looking approximately in direction of arrow "5B" shown in FIG. 5A, and showing a gate of the gate mechanism in a fully-closed position.

Referring to FIGS. 3, 4, 5A, and 5B, cam assembly 60 further includes first locking tab 62 and second locking tab 64. When cam assembly 60 is in position shown in FIGS. 3 and 5A, the first locking tab 62 prevents cam follower pin 70 from leaving cam surface 61. Thus, gate mechanism 50 as shown in FIGS. 3, 5A and 5B is in locked condition, gate 80 is in fully-closed position, and dispense and return slot 33 is blocked full-way.

Figure 6A:
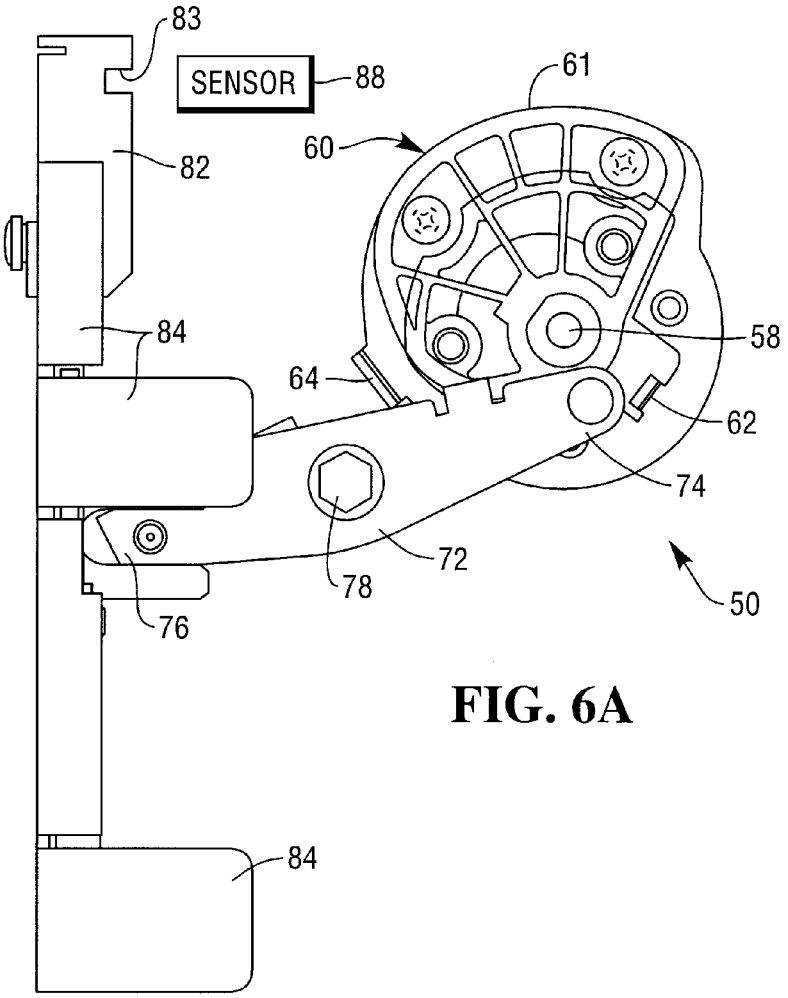
FIGS. 6A and 6B are elevational views similar to FIGS. 5A and 5B, and showing parts of the gate mechanism in an unlocked condition and the gate in a fully-closed position.
Figure 6B:
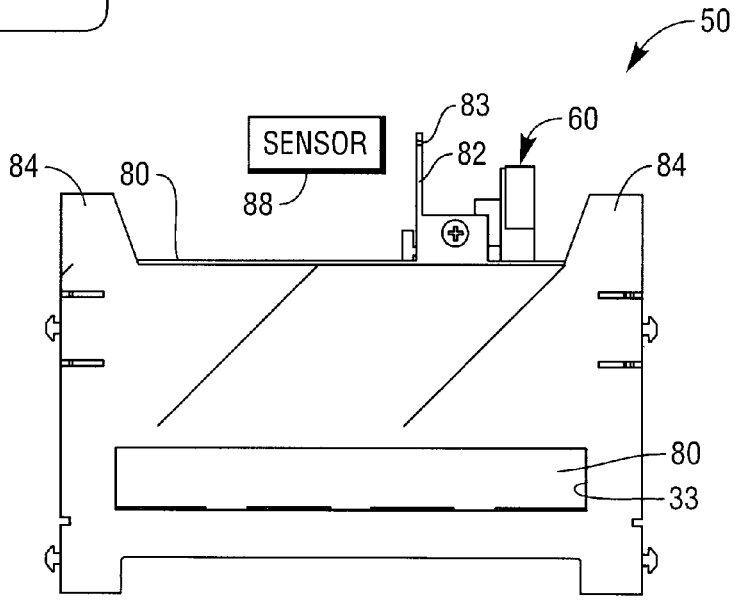

When cam assembly 60 is rotated a first angle (which may be about 36 degrees, for example) in counter-clockwise direction (as viewed looking at FIG. 5A) about pivot point 58 from position shown in FIG. 5A to position shown in FIG. 6A, the first locking tab 62 no longer prevents cam follower pin 70 from leaving cam surface 61. When cam assembly 60 moves from position shown in FIG. 5A to position shown in FIG. 6A, there is substantially no movement of cam follower pin 70 about pivot support 78. Thus, gate mechanism 50 as shown in FIGS. 6A and 6B is in unlocked condition, gate 80 remains in fully-closed position, and dispense and return slot 33 remains blocked full-way.

Figure 7A:
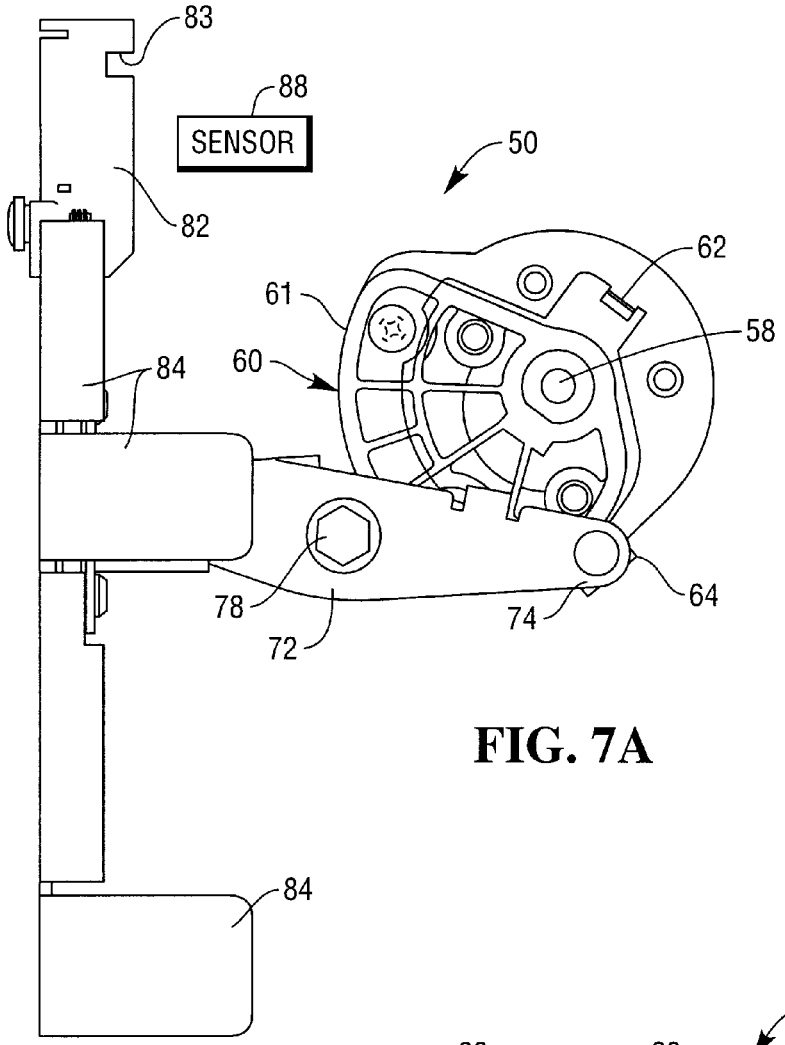
FIGS. 7A and 7B are elevational views similar to FIGS. 6A and 6B, and showing parts of the gate mechanism in a locked condition and the gate in a half-opened position.
Figure 7B:
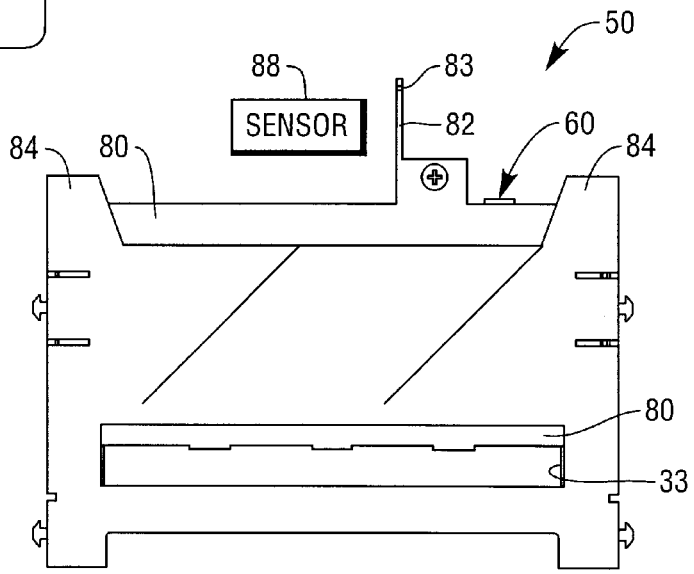

When cam assembly 60 is further rotated a second angle (which may be about 90 degrees, for example) in counter-clockwise direction (as viewed looking at FIG. 6A) about pivot point 58 from position shown in FIG. 6A to position shown in FIG. 7A, the second locking tab 64 moves into position to prevent cam follower pin 70 from leaving cam surface 61. When cam assembly 60 moves from position shown in FIG. 6A to position shown in FIG. 7A, there is sufficient amount movement of cam follower pin 70 about pivot support 78 such that linkage member 72 pivots about pivot support 78 in clockwise direction (as viewed looking at FIG. 6A). Linkage member 72 pivots about pivot support 78 a sufficient amount to open gate 80 about half-way (as best shown in FIG. 7B). Thus, gate mechanism 50 as shown in FIGS. 7A and 7B is in locked condition, gate 80 is in substantially half-opened (or substantially half-closed) position, and dispense and return slot 33 is open half-way (or closed half-way).

Figure 8A:
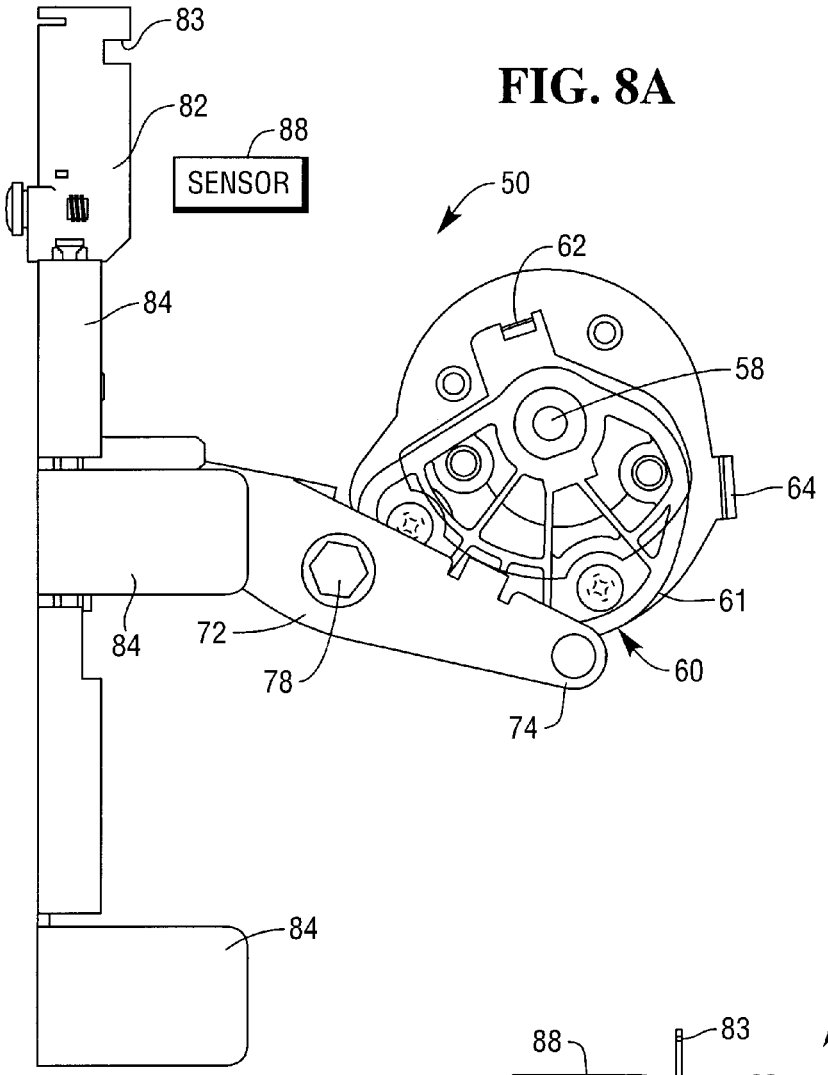
FIGS. 8A and 8B are elevational views similar to FIGS. 7A and 7B, and showing parts of the gate mechanism in an unlocked condition and the gate in a fully-opened position.
Figure 8B:
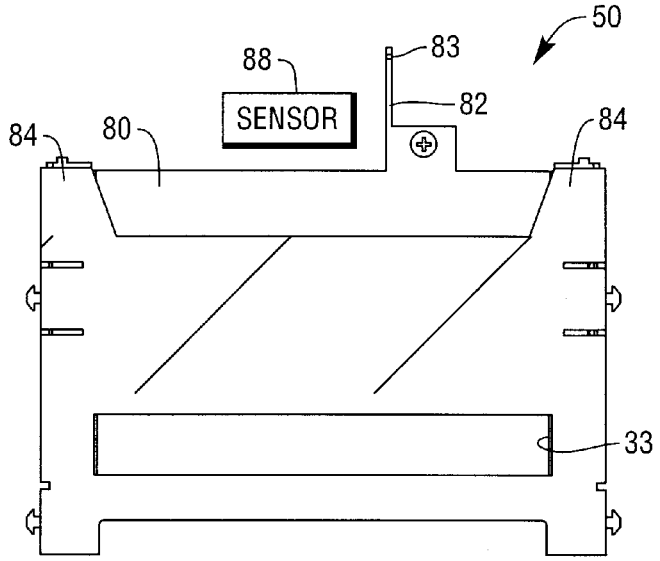

When cam assembly 60 is further rotated a third angle (which may be about 54 degrees, for example) in counter-clockwise direction (as viewed looking at FIG. 7A) about pivot point 58 from position shown in FIG. 7A to position shown in FIG. 8A, the second locking tab 64 no longer prevents cam follower pin 70 from leaving cam surface 61. When cam assembly 60 moves from position shown in FIG. 7A to position shown in FIG. 8A, there is sufficient amount movement of cam follower pin 70 about pivot support 78 such that linkage member 72 pivots about pivot support 78 in clockwise direction (as viewed looking at FIG. 7A). Linkage member 72 pivots about pivot support 78 a sufficient amount to open gate 80 full-way (as best shown in FIG. 8B). Thus, gate mechanism 50 as shown in FIGS. 8A and 8B is in unlocked condition, gate 80 is in substantially fully-opened position, and dispense and return slot 33 is open full-way.

Figure 9A:
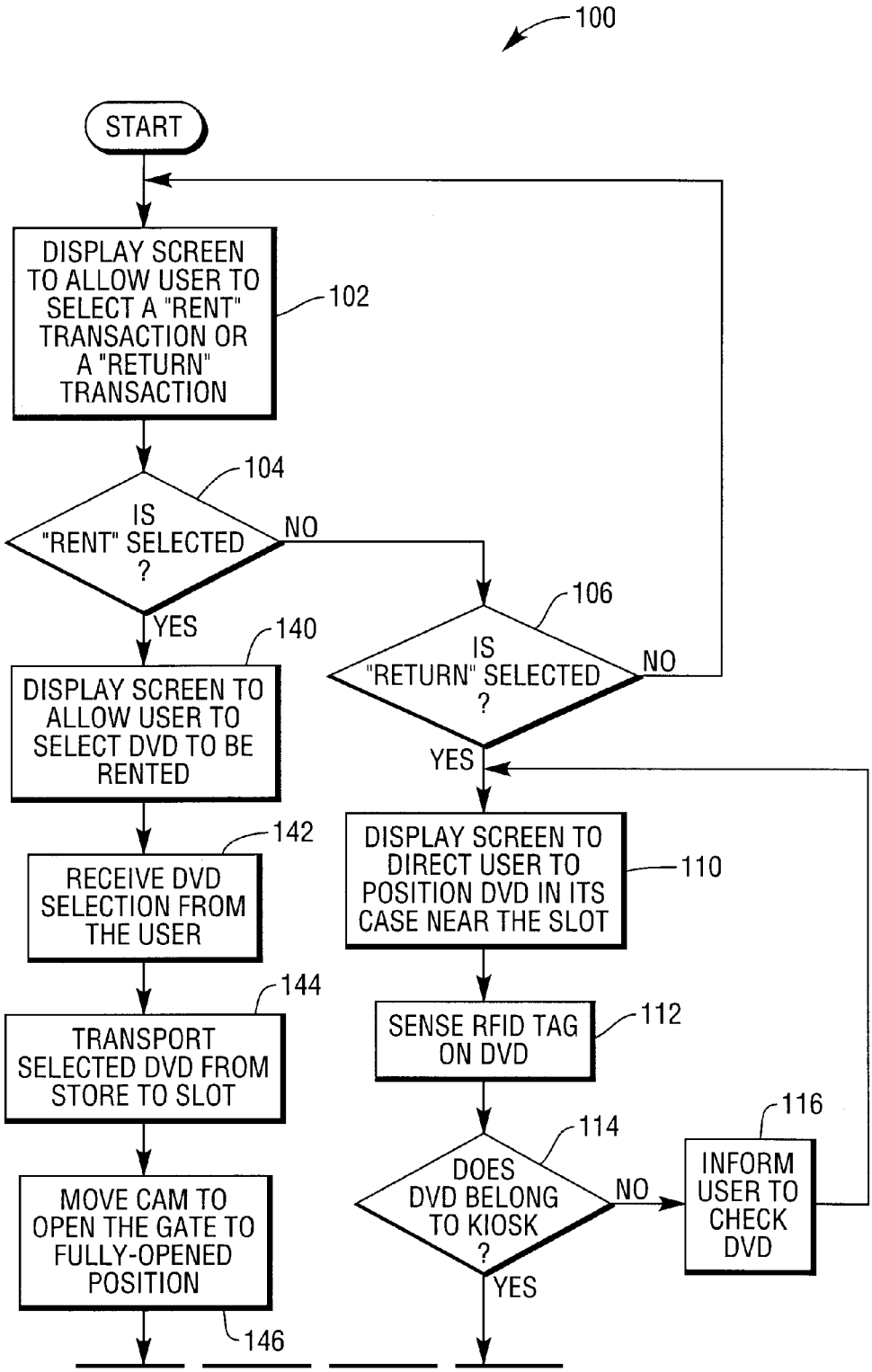
FIG. 9 is a flowchart depicting operation of the kiosk of FIGS. 1 and 2 in accordance with one embodiment.
Figure 9B:
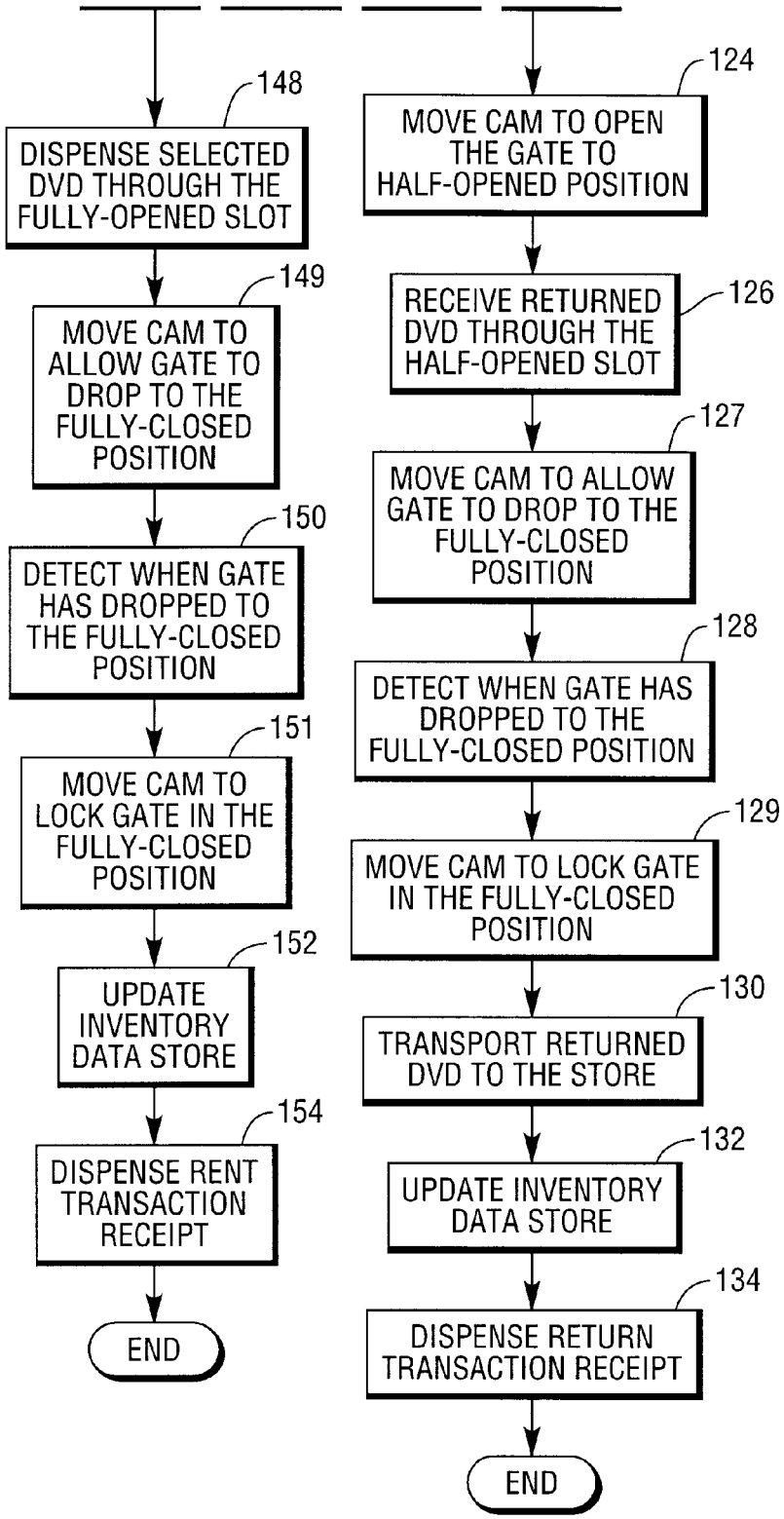

Referring to FIG. 9, flowchart 100 depicts operation of kiosk 12 shown in FIGS. 1 and 2 in accordance with one embodiment. When a customer arrives at kiosk 12, a screen appears on display 22 to allow the customer to select either a "rent" transaction or a "return" transaction (block 102). A determination is made as to whether the customer has selected a "rent" transaction (block 104).

If determination in block 104 is negative (i.e., a "rent" transaction has not been selected), the process proceeds to block 106 in which a determination is made as to whether the customer has selected a "return" transaction. If determination in block 106 is negative (i.e., a "return" transaction has not been selected), the process proceeds back to block 102 to display on the display 22 the screen which allows the customer to select either a "rent" transaction or a "return" transaction.

However, if determination in block 106 is affirmative (i.e., a "return" transaction has been selected), the process proceeds to block 110. In block 110, a screen appears on display 22 to direct the customer to position the DVD 40 in its case to be returned near the slot 33. RFID tag reader 30 then senses and reads RFID tag 42 on the DVD 40 to be returned (block 112).

A determination is then made in block 114 as to whether the DVD 40 to be returned belongs to the particular kiosk 12. More specifically, transaction software 38 looks up the digital media item associated with RFID tag 42 and verifies that DVD 40 belongs in kiosk 12. RFID tag 42 receives energy from an electromagnetic field and responds with a signal containing information identifying DVD 40. Transaction software 38 uses the information to determine whether to accept digital media storage device 40. Transaction software 38 may deny acceptance if no RFID tag 42 is present or if the identification information in RFID tag 42 is not included in inventory records within inventory data store 36.

If determination in block 114 is negative (i.e., the DVD 40 to be returned is determined to not belong to kiosk 12), then the process proceeds to block 116. In block 116, the customer is informed to check the DVD 40 to be returned. The customer may be informed by displaying an appropriate message on display 22, for example. The process then goes back to block 110 to display the screen to direct the customer to position the DVD 40 in its case to be returned near the slot 33.

However, if determination in block 114 is affirmative (i.e., the DVD 40 to be returned belongs to kiosk 12), the process proceeds to block 124. In block 124, computer 20 controls stepper motor 52 to move cam assembly 60 to move gate 80 from fully-closed position shown in FIGS. 5A, 5B to half-opened position shown in FIGS. 7A, 7B to allow the customer to insert DVD 40 in its case to be returned through the half-opened slot 33.

Since gate mechanism 50 is in locked condition shown in FIGS. 7A, 7B, the customer is unable to force or pry the gate 80 upwards in an effort to make the half-opened slot 33 larger. The half-opened slot 33 is just large enough to allow the customer to insert only one DVD in its case at a time through the half-opened slot 33.

After the returned DVD 40 in its case is received through the half-opened slot 33 (block 126), computer 20 controls stepper motor 52 to move cam assembly 60 from the position shown in FIG. 7A to the position shown in FIG. 6A (block 127). As cam assembly 60 moves from the position shown in FIG. 7A to the position shown in FIG. 6A, gate 80 is allowed to drop by gravity force from the half-opened position shown in FIG. 7B to the fully-closed position shown in FIG. 6B. As already described above, gate mechanism 50 is in unlocked condition shown in FIG. 6B, and cam follower pin 70 is allowed to move away from cam surface 61.

Sensor 88 detects when gate 80 has dropped completely to the fully-closed position shown in FIG. 6B, and provides a sensor output signal indicative thereof (block 128). In response to the sensor output signal from the sensor 88, computer 20 controls stepper motor 52 to move cam assembly 60 from the position shown in FIG. 6B to the position shown in FIG. 5B (block 129). Accordingly, gate mechanism 50 goes from unlocked condition (FIG. 6A) to locked condition (FIG. 5A) only when gate 80 has dropped all the way to the fully-closed position as indicated by the sensor output signal from sensor 88.

Computer 20 controls delivery system 34 to transport the returned DVD 40 in its case to a storage location within kiosk 12 (block 130). Transaction software 38 updates inventory data store 36 to reflect storage of returned DVD 40 in its case within kiosk 12 (block 132). Computer 20 controls printer 28 to print a DVD return transaction receipt which is delivered via printer receipt slot 29 to the customer to complete the DVD return transaction (block 134). Process then ends. Alternatively, process may go back to block 102 to display the screen which allows the customer to select either a "rent" transaction or a "return" transaction as already described hereinabove.

However, if determination back in block 104 is affirmative (i.e., a "rent" transaction has been selected), the process proceeds to block 140. In block 140, a screen appears on display 22 to allow the customer to select a DVD to be rented. After the customer selects the DVD to be rented (block 142), the process proceeds to block 144. In block 144, computer 20 controls delivery system 34 to transport the DVD in its case to be rented from a storage location within kiosk 12 to slot 33.

Then in block 146, computer 20 controls stepper motor 52 to move cam assembly to gate 80 from fully-closed position shown in FIG. 5A, 5B to fully-opened position shown in FIGS. 8A, 8B. The slot 33 is uncovered and the DVD in its case to be rented is dispensed through the fully-opened slot 33 (block 148).

After the DVD to be rented is dispensed through fully-opened slot 33, computer 20 controls stepper motor 52 to move cam assembly 60 from the position shown in FIG. 8A to the position shown in FIG. 6A (block 149). As cam assembly 60 moves from the position shown in FIG. 8A to the position shown in FIG. 6A, gate 80 is allowed to drop by gravity force from the fully-opened position shown in FIG. 8B to the fully-closed position shown in FIG. 6B. As already described above, gate mechanism 50 is in unlocked condition shown in FIG. 6B, and cam follower pin 70 is allowed to move away from cam surface 61.

Sensor 88 detects when gate 80 has dropped completely to the fully-closed position shown in FIG. 6B, and provides a sensor output signal indicative thereof (block 150). In response to the sensor output signal from the sensor 88, computer 20 controls stepper motor 52 to move cam assembly 60 from the position shown in FIG. 6B to the position shown in FIG. 5B (block 151). Accordingly, gate mechanism 50 goes from unlocked condition (FIG. 6A) to locked condition (FIG. 5A) only when gate 80 has dropped all the way to the fully-closed position as indicated by the sensor output signal from sensor 88.

Transaction software 38 updates inventory data store 36 to reflect rental status of the DVD which has just been dispensed to the customer (block 152). Computer 20 then controls printer 28 to print a DVD rent transaction receipt which is delivered via printer receipt slot 29 to the customer to complete the DVD rent transaction (block 154). Process then ends. Alternatively, process may go back to block 102 to display the screen which allows the customer to select either a "rent" transaction or a "return" transaction as already described hereinabove.

It should be apparent that gate mechanism 50 is in locked condition only when gate 80 is in either the half-opened position (FIG. 7B) or the fully-closed position (FIG. 5B). By locking the gate mechanism 50 when gate 80 is fully-closed, customers (and non-customers) are prevented from forcing the gate open and inserting debris into dispense and return slot 33. By locking the gate mechanism 50 when gate 80 is half-opened, customers returning multiple DVDs are prevented from inserting or trying to force more than one DVD at a time through the reduced-size opening. This reduces chance of a jam condition occurring in dispense and return slot 33. Accordingly, the number of service calls to clear jam conditions should be reduced, resulting in reduced operating costs for kiosk 12.

It should also be apparent that when gate 80 moves from the fully-opened position (FIG. 8B) or the half-opened position (FIG. 7B) to the fully-closed position (FIG. 6B), the gate is able to "give" if the gate encounters an object during its movement by gravity force to the fully-closed position. Gate 80 gives because cam follower pin 70 is able to move away cam surface 61 if gate encounters an object.

It should further be apparent that gate mechanism 50 is unable to go from an unlocked condition (such as shown in FIG. 6A) to a locked condition (such as shown in FIG. 5A) until gate 80 has completely dropped to fully-closed position as indicated by the sensor output signal from sensor 88. This prevents cam assembly 60 in moving from FIG. 6A to FIG. 5A to lock gate 80 in the fully-closed position until sensor output signal from sensor 88 confirms that gate 80 has reached the fully-closed position.

It should also be apparent that only a single cam (i.e., a single cam surface 61) is used to provide the lockable three-position gate mechanism 50 as described hereinabove. This reduces complexity, resulting in lower costs to provide functionality as described herein.

While the present invention has been illustrated by the description of example processes and system components, and while the various processes and components have been described in detail, applicant does not intend to restrict or in any limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A digital media rental and return kiosk comprising:

a store arranged to store physical digital media items;

a customer-accessible user interface (i) having a dispense and return slot, and (ii) arranged to enable a customer to interact with the kiosk to either rent a digital media item from the store or return the digital media item to the store through the slot;

a delivery system arranged to (i) transport the digital media item from the store to the slot during a dispense mode of operation, and (ii) transport the digital media item from the slot to the store during a return mode of operation; and a gate, mechanism including a gate which is movable from a closed position to a first opened position exposing a first amount of the slot to the customer to allow the customer to retrieve the digital media item through the first amount of the slot during the dispense mode of operation, and (ii) movable from the closed position to a second opened position exposing a second amount of the slot to the customer which is different from the first amount of the slot to allow the customer to insert the digital media item through the second amount of the slot during the return mode of operation.

2. A digital media rental and return kiosk according to claim 1, wherein the second position is substantially a half-opened position of the gate.

3. A digital media rental and return kiosk according to claim 2, wherein (i) the first opened position is substantially a fully-opened position of the gate, and (ii) the closed position is substantially a fully-closed position of the gate.

4. A digital media rental and return kiosk according to claim 1, wherein the gate mechanism comprises a cam assembly including (i) a cam follower pin operatively coupled, to the gate, (ii) a single cam having a cam surface on which the cam follower pin can ride, and (ii) a stepper motor arranged to rotate the single cam such that the gate moves between different positions as the cam follower pin rides along the cam surface during rotation of the single cam.

5. A digital media rental and return kiosk according to claim 4, wherein the cam assembly includes a locking tab which prevents the cam follower pin from leaving the cam surface when the single cam is in its position corresponding to the gate being in the substantially half-opened position.

6. A digital media rental and return kiosk according to claim 4, wherein the cam assembly includes a locking tab which prevents the cam follower pin from leaving the cam surface when the single cam is in its position corresponding to the gate being in the substantially fully-closed position.

7. A digital media rental and return kiosk according to claim 4, wherein the cam assembly includes (i) a first locking tab which prevents the cam follower pin from leaving the cam surface when the single cam is in its position corresponding to the gate being in the substantially half-opened position, and (ii) a second locking tab which prevents the cam follower pin from leaving the cam surface when the single cam is in its position corresponding to the gate being in the substantially fully-closed position.

8. A digital media rental and return kiosk according to claim 4, further comprising a sensor arranged to sense position of the gate and to provide a sensor output signal indicative thereof.

9. A media rental and return kiosk according to claim 4, further comprising a controller arranged to (i) monitor the sensor output sensor signal from the sensor, and (ii) control the stepper motor to enable the gate move between different positions in response to the sensor output signal from the sensor.

10. A digital media rental and return kiosk according to claim 1, wherein the gate is (i) movable from the first opened position to the closed position by gravity force, and (ii) movable from the second opened position to the closed position by gravity force.

* * * * *